US010204508B2

(12) United States Patent
Meah

(10) Patent No.: US 10,204,508 B2
(45) Date of Patent: Feb. 12, 2019

(54) FIRE DETECTOR DRIFT COMPENSATION

(71) Applicant: Thorn Security Limited, Sunbury-on-Thames, Middlesex (GB)

(72) Inventor: Faruk Meah, Woking (GB)

(73) Assignee: Thorn Security Limited, Sunbury-on-Thames (GB)

( * ) Notice: Subject to any disclaimer, the term of this patent is extended or adjusted under 35 U.S.C. 154(b) by 0 days.

(21) Appl. No.: 15/570,804

(22) PCT Filed: Apr. 29, 2016

(86) PCT No.: PCT/GB2016/051249
§ 371 (c)(1),
(2) Date: Oct. 31, 2017

(87) PCT Pub. No.: WO2016/178006
PCT Pub. Date: Nov. 10, 2016

(65) Prior Publication Data

US 2018/0158313 A1 Jun. 7, 2018

(30) Foreign Application Priority Data

May 1, 2015 (GB) ..... 1507574.0

(51) Int. Cl.
*G08B 29/24* (2006.01)
*G08B 17/10* (2006.01)
*G08B 21/18* (2006.01)

(52) U.S. Cl.
CPC ..... *G08B 29/24* (2013.01); *G08B 17/10* (2013.01); *G08B 21/182* (2013.01)

(58) Field of Classification Search
CPC ..... G08B 29/24; G08B 17/10; G08B 21/182
(Continued)

(56) References Cited

U.S. PATENT DOCUMENTS 3,940,753 A 2/1976 Muller
4,222,046 A 9/1980 Pinckaers et al.
(Continued)

FOREIGN PATENT DOCUMENTS

EP 0 501 194 A1 9/1992
EP 0788082 A2 8/1997
(Continued)

OTHER PUBLICATIONS

International Preliminary Report on Patentability of the International Searching Authority, dated Nov. 16, 2017, from International Application No. PCT/GB2016/051249, filed on Apr. 29, 2016. 9 pages.

(Continued)

*Primary Examiner* — Zhen Y Wu
(74) *Attorney, Agent, or Firm* — HoustonHogle LLP

(57) ABSTRACT

A fire detector system comprises a fire detector unit; a sensor disposed in the fire detector unit and arranged to detect the characteristics of a fire and to generate an output signal indicative of the characteristics detected by the sensor; and a processor arranged to receive the output signal from the sensor and to generate afire alarm signal when the output signal exceeds an alarm point threshold; wherein the system is arranged to change the alarm point threshold over time to compensate for drift in the response of the detector unit; wherein the fire detector unit includes a first sensitivity mode with a first drift compensation limit and a second sensitivity mode with a second drift compensation limit, the second sensitivity mode being more sensitive than the first; and wherein, as the first alarm point threshold in the first sensitivity mode is approached or reached, the mode of the system is changed to the second sensitivity mode.

29 Claims, 3 Drawing Sheets

(58) Field of Classification Search
USPC ..... 340/628
See application file for complete search history.

(56) References Cited

U.S. PATENT DOCUMENTS

| | | | | |
|---|---|---|---|---|
| 4,225,860 | A | 9/1980 | Conforti | |
| 4,384,488 | A | 5/1983 | Scheidweiler | |
| 4,475,390 | A | 10/1984 | Scheidweiler | |
| 4,524,281 | A | 6/1985 | Muggli et al. | |
| 4,559,453 | A | 12/1985 | Muggli et al. | |
| 4,975,684 | A * | 12/1990 | Guttinger | G08B 17/00 340/522 |
| 5,422,629 | A | 6/1995 | Minnis | |
| 5,497,144 | A | 3/1996 | Schappi et al. | |
| 5,652,563 | A * | 7/1997 | Maus | A01K 29/00 119/773 |
| 6,753,786 | B1 * | 6/2004 | Apperson | G08B 17/10 340/514 |
| 7,075,445 | B2 * | 7/2006 | Booth | G08B 17/103 340/630 |
| 9,349,279 | B2 * | 5/2016 | Sangha | G08B 29/043 |
| 2002/0080040 | A1 * | 6/2002 | Schneider | G08B 17/107 340/628 |
| 2002/0156166 | A1 * | 10/2002 | Elendu | C09K 3/30 524/386 |
| 2003/0090374 | A1 * | 5/2003 | Quigley | G08B 19/005 340/506 |
| 2006/0164253 | A1 * | 7/2006 | Harvey | G08B 17/10 340/628 |
| 2006/0261967 | A1 * | 11/2006 | Marman | G08B 17/103 340/630 |
| 2006/0273896 | A1 * | 12/2006 | Kates | G08B 21/0236 340/539.18 |
| 2008/0180258 | A1 * | 7/2008 | Lang | G08B 17/00 340/584 |
| 2012/0212346 | A1 * | 8/2012 | Conforti | G08B 17/10 340/628 |
| 2014/0015680 | A1 * | 1/2014 | Chandler | G08B 17/12 340/630 |

FOREIGN PATENT DOCUMENTS

| | | | |
|---|---|---|---|
| EP | 0 818 765 | A1 | 1/1998 |
| EP | 1 100 061 | A2 | 5/2001 |
| EP | 1098284 | A2 | 5/2001 |

OTHER PUBLICATIONS

International Search Report and Written Opinion of the International Searching Authority, dated Jul. 28, 2016, from International Application No. PCT/GB2016/051249, filed on Apr. 29, 2016. 9 pages.

Search and Examination Reports, completed on Nov. 4, 2015, from GB Application No. 1507574.0, filed on May 1, 2015. 4 pages.

* cited by examiner

FIRE DETECTOR DRIFT COMPENSATION

RELATED APPLICATIONS

This application is a § 371 National Phase Application of International Application No. PCT/GB2016/051249, filed on Apr. 29, 2016, now International Publication No. WO 2016/178006 A1, published on Nov. 10, 2016, which International Application claims priority to GB Application No. 1507574.0, filed on May 1, 2015, both of which are incorporated herein by reference in their entirety.

BACKGROUND OF THE INVENTION

The present invention relates to a method of compensating for drift within a fire detector, to a fire detector arranged to compensate for drift, and to a fire detector system.

After installation, it is known that most fire detectors will deteriorate over a period of time, and their response characteristics will change, normally owing to a build-up of dirt. This is particularly acute when a detector is located outside or in a location exposed to a large amount of dust or dirt. In such locations, it might be necessary to replace or clean the fire detector on a very regular basis to ensure that its response remains within acceptable limits. Such a fire detector will detect the characteristics of a fire, such as the presence of smoke particles, radiation of a certain wavelength indicative of a fire or heat, and when the characteristics exceed a threshold, an alarm will be signalled.

For example, a known type of smoke detector includes a detector chamber defining a detection region which is shielded from the light of the surrounding area, but which permits entry of air into the detector chamber. The detector chamber includes a light source, typically in the form of an LED, and a light detector, each of which is separated from the other by structural features which mean that light cannot pass directly from the light source to the light detector. In the event that a fire occurs, smoke will be carried into the detector chamber by the air, and light from the light source will be reflected or scattered from the smoke particles. The reflected or scattered light will be detected by the light detector, the amount of reflected light being indicative of the amount of smoke in the air within the detector chamber. Thus, as the amount of smoke in the air increases, the response of the fire detector increases accordingly.

Over time, dirt gradually builds up in the detector unit, for example on the internal walls of the detector chamber. Therefore, over a long period of time, the light detector is able to detect light which reflects off the dirt which has built up on the detector walls, giving a positive response. This can be seen in FIG. 1 in which the detector output signal is plotted against time. Over a long period of time, the response from the detector output signal gradually increases.

It will be appreciated that, if there is a fire in the vicinity of the smoke detector, the output signal of the detector will significantly increase as smoke enters the detector chamber until it crosses a pre-set value which is the alarm threshold. When it crosses the alarm threshold, an alarm is signalled, and a siren will sound. It will be appreciated from FIG. 1 that, when the smoke detector is first commissioned, the amount of smoke that must enter the detector chamber before the alarm threshold is crossed will be sufficiently large that the alarm is not triggered by other environmental conditions which might cause a false alarm. This is indicated by double-headed arrow A. Later in the detector's life, the sensitivity of the detector actually increases because the amount of smoke or airborne particles required to trigger an alarm condition is much less, as indicated by double headed arrow B. The point comes where the sensitivity is increased to a level where the likelihood of a false alarm being triggered by a non-fire condition becomes too great.

Of course, in the smoke detector described above, over time, the detector becomes more sensitive. Other types of detector become less sensitive with age and with the build up of dirt. In the case of a detector which becomes less sensitive, the response might be indicated in a graph with a response which gradually drops over time, rather than increases, so that the sensitivity decreases rather than increases.

It is known to compensate for the change in response of a fire detector over time by gradually changing the alarm threshold which must be crossed for an alarm to be triggered. The rate at which the threshold is changed can be set depending on the environment in which the fire detector is installed. In a very dirty environment, the threshold will be changed relatively quickly compared with a fire detector installed in a relatively cleaner environment. The change in the threshold is either implemented in the detector hardware or, more commonly, within a software algorithm running within the detector. The response of a smoke detector similar to the one described above is shown in FIG. 2, in which the alarm threshold increases in line with the response from the detector. As a result, the sensitivity remains the same over a long period of time as is indicated by double headed arrow C which indicates a distance between the detector output signal and the alarm threshold.

Of course, the point is reached when the fire detector is no longer able to resolve a fire alarm because the end of the dynamic range of the detector has been reached. Any further change in the threshold would mean that the fire detector would not be able to resolve a fire alarm, thereby risking the missing of a real alarm event, and this point is known as the drift compensation limit. The fire detector may be arranged so that, prior to reaching the drift compensation limit, a pre-warning is given to allow the fire detector to be replaced or cleaned. When it actually reaches the drift compensation limit, the fire detector is arranged to signal a warning or a fault.

It will be understood, therefore, that after a period of time, the drift compensation limit will be reached, and the fire detector must be cleaned or replaced. In a dirty environment, this point might be reached quite quickly, and this represents a regular expense. It would be advantageous if the frequency of cleaning or replacing the fire detector can be reduced.

SUMMARY OF THE INVENTION

According to a first aspect of the invention, a fire detector system comprises a fire detector unit;

- a sensor disposed in the fire detector unit and arranged to detect the characteristics of a fire and to generate an output signal indicative of the characteristics detected by the sensor; and
- a processor arranged to receive the output signal from the sensor and to generate a fire alarm signal when the output signal exceeds an alarm point threshold;
- wherein the system is arranged to change the alarm point threshold over time to compensate for drift in the response of the detector unit to the characteristics of a fire;
- wherein the fire detector unit includes a first sensitivity mode with a first drift compensation limit and a second sensitivity mode with a second drift compensation limit, the second sensitivity mode being more sensitive than the first; and wherein as the alarm point threshold in the first sensitivity mode approaches or reaches the first drift compensation limit, the mode of the system is changed to the second sensitivity mode.

In this way, the length of service of the fire detector system is extended because the alarm point threshold is changed from one mode to the next to keep it within the dynamic range of the sensor.

The alarm point threshold in this specification refers to the output from the sensor at which an alarm condition is signalled. For example, in the case of a smoke detector, as smoke enters the detector, the output of the sensor will increase until the alarm point threshold is reached, at which point an alarm condition is signalled.

In this specification, reference is made to drift compensation limits. It will be appreciated that, in the first mode over time, the alarm point threshold can increase or decrease as part of a first order of drift compensation. The point comes where the alarm point threshold reaches or approaches the end of the dynamic range of the sensor, and at that point, the detector unit is unable to properly detect whether or not the alarm point threshold has been reached. That point is the drift compensation limit, and will normally be the same for each of the modes.

Preferably, the processor is disposed within the fire detector unit, although it can be located elsewhere, for example within a control panel. An advantage of the processor being located within the fire detector unit is that, where more than one fire detector unit is included within a fire detector system, each one can be programmed individually.

Where the sensor is an analogue sensor, an analogue to digital convertor can be included in the fire detector unit which is connected to the sensor and is arranged to generate the output signal.

In one embodiment, the alarm point threshold of the second sensitivity mode corresponds to a lower output signal of the sensor than the alarm point threshold of the first sensitivity mode. In this way, as the drift compensation limit is reached or approached in one mode, switching to a more sensitive mode moves the alarm point threshold downwards so that the drift compensation limit of the second sensitivity mode is further away than it would be in the first sensitivity mode.

In one arrangement, there are at least three sensitivity modes, and when the sensitivity mode is changed, it is changed to the sensitivity mode which is immediately more sensitive. In another arrangement, the sensitivity mode can be changed to a sensitivity mode which is more sensitive than the sensitivity mode that is immediately more sensitive. In other words, it is possible for sensitivity modes to be skipped, if appropriate. Whether modes are skipped might depend on the extent to which adjacent modes have overlapping dynamic ranges.

Advantageously, the processor is arranged to have a most sensitive sensitivity mode limit which defines the most sensitive mode into which it can be placed. Typically, this will not be the most sensitive possible mode available to the detector unit, but one which is predefined during installation.

The processor is preferably arranged to define a least sensitive sensitivity mode limit which defines the least sensitive mode into which it can be placed.

Preferably, the system further comprises a memory. The memory might be used to store the programme executed by the processor and/or the parameters by which a detector is controlled. Such parameters might include the least sensitive sensitivity mode limit, the most sensitive sensitivity mode limit and the rate of drift compensation, and for each of the modes, the alarm point threshold, the drift compensation limit and the drift allowance.

In one arrangement, the fire detector unit includes a second sensor. The sensors might be of different types. The sensors might face in different directions. The sensors might be arranged to compensate for drift independently of each other to take account of their different rates of drift. The sensors can be arranged to have different settings of one or more of the following: rate of drift compensation; drift compensation limit; most sensitive sensitivity mode limit; and least sensitive sensitivity mode limit.

The sensors may be disposed in the fire detector unit, or the system may include a second fire detector unit in which the second sensor is disposed.

A second aspect of the present invention is a method of compensating for drift in a fire detector unit having a sensor arranged to detect the characteristics of a fire and to generate an output signal indicative of the characteristics detected by the sensor, the method involving a processor arranged to receive the output signal from the sensor and to control the response by indicating a fire when the output signal exceeds an alarm point threshold, the method comprising:

(1) placing the fire detector unit in a first sensitivity mode with a first drift compensation limit;

(2) changing the alarm point threshold over time to compensate for drift in the response of the detector unit to the characteristics of a fire;

(3) changing the mode of the unit from the first sensitivity mode to a second sensitivity mode with a second drift compensation limit and which is a more sensitive mode than the first sensitivity mode as the alarm point threshold in the first sensitivity mode approaches or reaches the first drift compensation limit;

(4) changing the alarm point threshold over time to compensate for drift in the response of the detector unit to the characteristics of a fire.

In this way, the length of service of the fire detector system is extended because the alarm point threshold is changed from one mode to the next to keep it within the dynamic range of the sensor.

Preferably, the output signal is a digital output signal. The sensor may generate an analogue output signal which is converted to the digital output signal.

In one embodiment, the alarm point threshold of the second sensitivity mode corresponds to a lower output signal from the sensor than that of the alarm point threshold of the second sensitivity mode. In this way, as the drift compensation limit is reached or approached in the first sensitivity mode, switching to the second sensitivity mode moves the alarm point threshold downwards so that the drift compensation limit for the second sensitivity mode is further away than it would be in the first sensitivity mode.

According to one arrangement, the method further comprises:

changing the mode of the unit from the second sensitivity mode to a third sensitivity mode with a third drift compensation limit and which is a more sensitive mode than the second sensitivity mode as the alarm point threshold in the second sensitivity mode approaches or reaches the second drift compensation limit.

In some arrangements, the fire detector unit has at least three sensitivity modes and when the sensitivity mode is changed, it is changed to the sensitivity mode which is immediately more sensitive. According to an alternative arrangement, when the sensitivity is changed, it can be changed to a sensitivity mode which is more sensitive than the sensitivity mode that is immediately more sensitive. Whether modes are skipped might depend on the extent to which adjacent modes have overlapping dynamic ranges.

Advantageously, the fire detector unit is arranged to have a most sensitive sensitivity mode limit which defines the most sensitive mode into which it can be placed. Typically this will not be the most sensitive possible mode available to the detector unit, but one which is predefined during installation.

Preferably, the fire detector unit is arranged to have a least sensitive sensitivity mode limit which defines the least sensitive mode into which it can be placed.

In some arrangements, a second sensor is included, wherein the sensors are arranged such that they can be set to compensate to drift independently of each other. Advantageously, the sensors can be arranged to have different settings of one or more of the following: rate of drift compensation; drift compensation limits; most sensitive sensitivity mode limit; least sensitive sensitivity mode limit. The method might further comprise the use of a second fire detector unit in which the second sensor is disposed.

According to a third aspect of the present invention, a fire detector unit comprises: a sensor disposed in the fire detector unit and arranged to detect the characteristics of a fire and to generate an output signal indicative of the characteristics detected by the sensor; and a processor arranged to receive the output signal from the sensor and to control the response by indicating a fire when the output signal exceeds an alarm point threshold;

wherein the fire detector unit is arranged to change the alarm point threshold over time to compensate for drift in the response of the detector unit to the characteristics of a fire;

wherein the fire detector unit includes a first sensitivity mode with a first drift compensation limit and a second sensitivity mode with a second drift compensation limit, the second sensitivity mode being more sensitive than the first; and wherein, as the alarm point threshold in the first sensitivity mode approaches or reaches the first drift compensation limit, the mode of the fire detector unit is changed to the second sensitivity mode.

BRIEF DESCRIPTION OF THE DRAWINGS

The present invention will be now be described by way of example only with reference to the accompanying drawings in which.

DETAILED DESCRIPTION OF THE PREFERRED EMBODIMENTS

Figure 1:
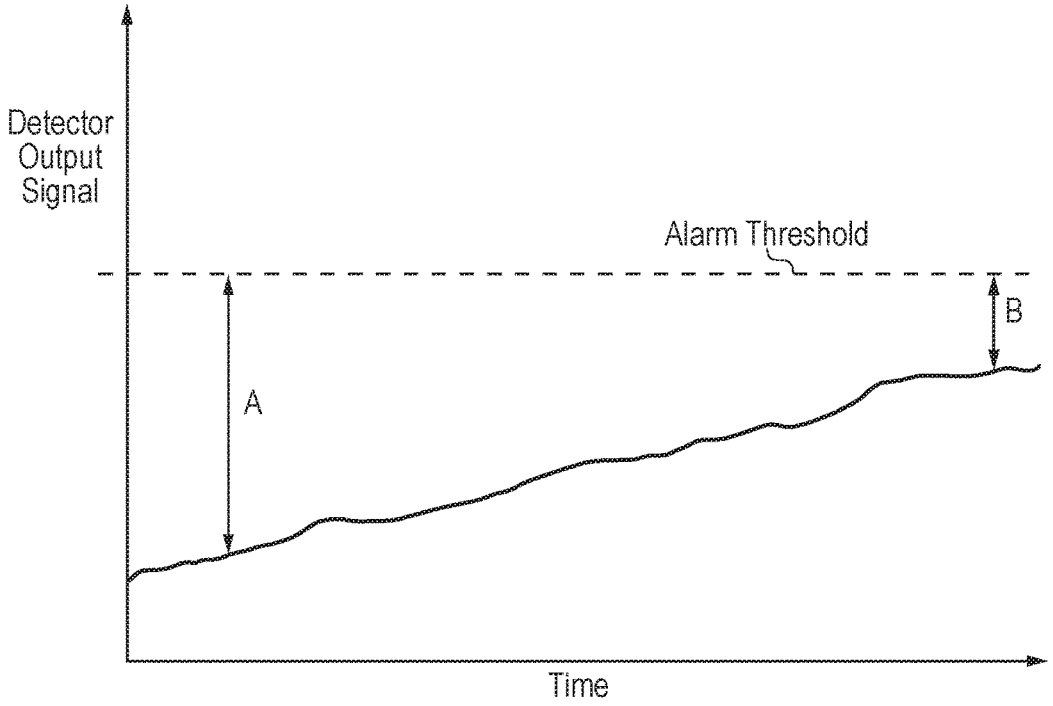
FIG. 1 is a graph showing the response of a known smoke detector relative to a fixed alarm threshold.
Figure 2:
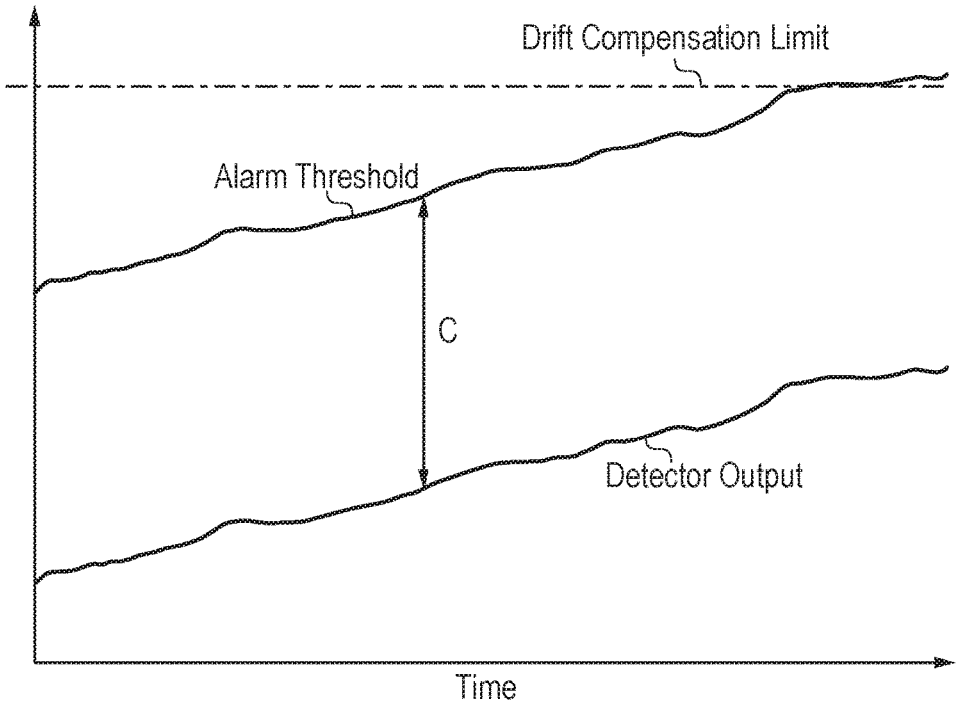
FIG. 2 is a graph showing the response of a smoke detector over a period of time having a moving alarm threshold.
Figure 3:
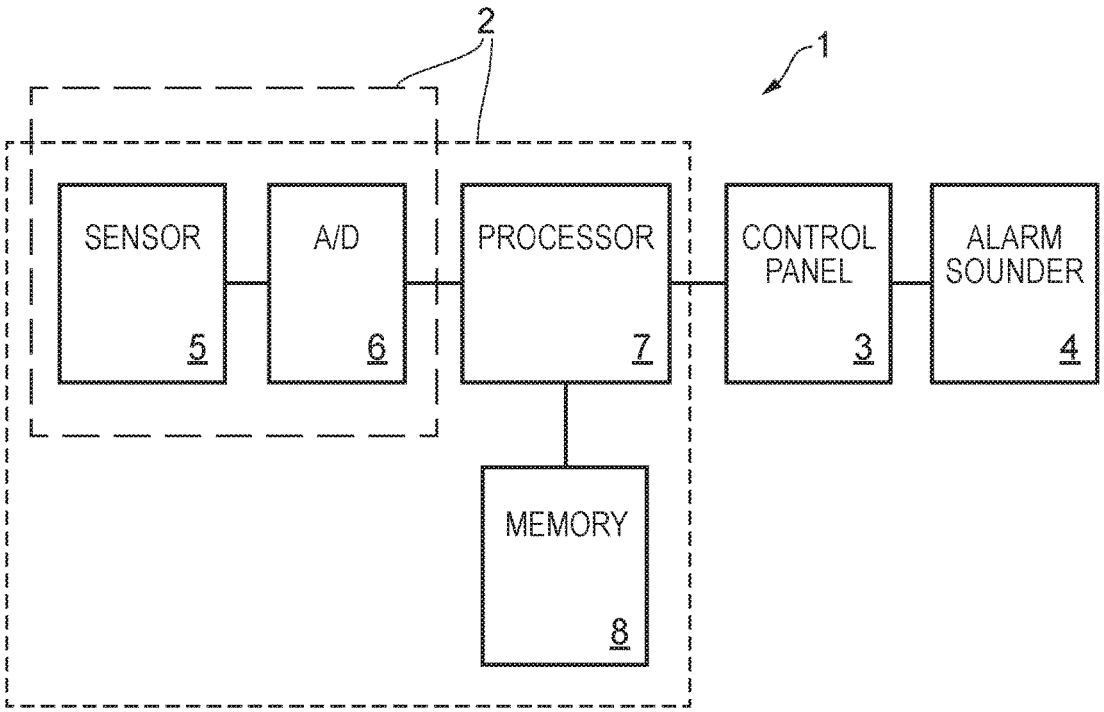
FIG. 3 is a block diagram of a fire detector system according to the present invention.

FIG. 3 is a block diagram showing the layout of a fire detector system 1 having a fire detector unit 2 which detects a fire, a control panel 3 (often known as "control and indicating equipment") and an alarm sounder 4 which generates an audible alarm signal sound to warn people of the existence of a fire. The fire detector unit 2 includes a sensor 5 and an analogue to digital convertor 6. Depending on the type of detector, it might also include a processor 7 and a memory 8. Alternatively, if the fire detector unit 2 does not include the processor 7 and the memory 8, these will be included elsewhere in the fire detector system 1, perhaps within the control panel 3. For this reason, the fire detector unit 2 is shown in two possible different forms in FIG. 3, firstly a simple fire detector unit 2 which does not include the processor 7 and the memory 8 and which is delimited by the box with a large dashed line, and secondly a more complicated fire detector unit 2 which also includes the processor 7 and the memory 8, shown delimited by a box with a smaller dashed line.

In this instance, the sensor produces an analogue output signal indicative of whether it detects the characteristics of a fire which is converted to a digital output signal by the analogue to digital convertor. Of course, if the sensor were a digital one, no analogue to digital convertor will be required.

The sensor 5 can be any one of a number of different types, including a radiation sensor arranged to detect radiation within a certain range of wavelengths corresponding to the wavelength of radiation emitted by a fire, a heat detector, a smoke detector or the like. By way of example, this embodiment will be described with a smoke detector. With this type of smoke detector, a detector chamber is included which defines a detection region which is shielded from the light of the surrounding area, but which permits entry of air into the detector chamber. The detector chamber includes a light source typically in the form of an LED, and a light detector, each of which is separated from the other by structural features which mean that light cannot pass directly from the light source to the light detector. In the event that a fire occurs, smoke will be carried into the detector chamber by the air, and light from the light source will be reflected or scattered from the smoke particles. The reflected or scattered light will be detected by the light detector, the amount of reflected light being indicative of the amount of smoke in the air within the detector chamber. Thus, as the amount of smoke in the air increases, the response of the fire detector increases accordingly.

Figure 5:
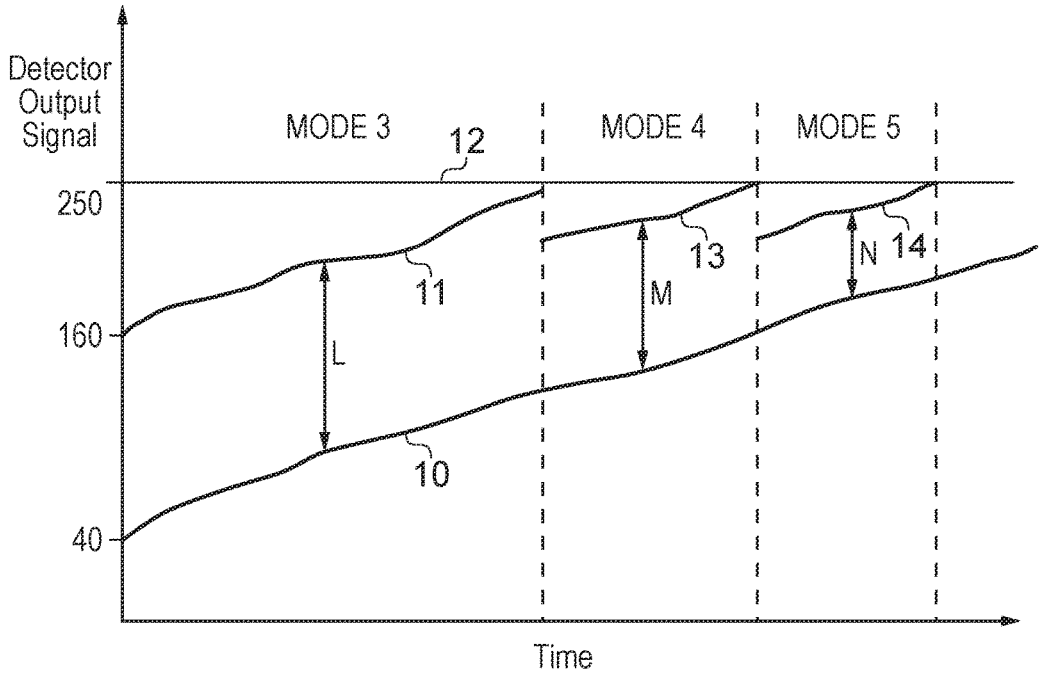
FIG. 5 is a graph showing the response of a smoke detector according to the present invention.

Over time, dirt gradually builds up in the detector unit, for example on the internal walls of the detector chamber. Therefore over a long period of time, the light detector is able to detect light which reflects off the dirt which has built up on the detector walls giving a positive response. This can be seen in FIG. 5 in which the detector output signal 10 is plotted against time. Over a long period of time, the response from the detector output signal gradually increases.

As is mentioned above, as the characteristics of the fire are increasingly detected, the response from the sensor increases causing the output signal from the analogue to digital convertor to increase. In this case, for example, an 8-bit analogue to digital convertor works in the range of 0-255, with an output signal of 0 corresponding to a zero output signal from the sensor 5 with no fire being detected, and an output signal of 255 representing the maximum output signal from the sensor indicating a very intense fire. The processor 7 receives the output signal from the analogue to digital convertor 6 and controls the response of the fire detector or fire detector system to the characteristics of a fire which is sent to the control panel 3. The processor is software controlled in this embodiment, its operation being controlled by the software and by parameters which are saved within the memory 8.

For example, if the fire detector unit 2 is set to a low sensitivity, it will require the output signal of the sensor 5 to cause the analogue to digital convertor 6 to output a signal of, say, a value of 200 before the processor considers that a fire has been detected, at which point an alarm condition is transmitted to the control panel 3, and the control panel 3 causes the alarm sounder 4 to be activated so as to generate an alarm noise. In this case, 200 is considered to be the alarm point threshold. If the fire detector unit is set to a higher sensitivity, it will require the output signal of the sensor 5 to cause the analogue to digital convertor 6 to output an output signal of, say, a value of 100 before the processor considers that a fire has been detected. In this case 100 is considered to be the alarm point threshold.

As discussed above, a fire detector unit tends to change in its responsiveness over time, particularly where it is located in a dirty environment. In the case of the smoke detector mentioned above, as the fire detector unit 2 accumulates dirt, it begins to become responsive to the dirt, resulting in an upward drift in its output signal. The memory 8 therefore includes a routine by which the alarm point threshold increases over time from, for example, 160 to 250, giving a drift allowance of 90 over time. The rate of drift compensation depends on the environment in which the detector unit 2 is located. The dirtier the environment, the faster the rate of drift compensation. It will be appreciated that, as the alarm point threshold increases from 160 to 250, the sensitivity of the detector unit remains the same. This ensures that the fire detector unit 2 does not become less responsive to the outbreak of a fire. This can be described as the first order of drift compensation.

Figure 4:
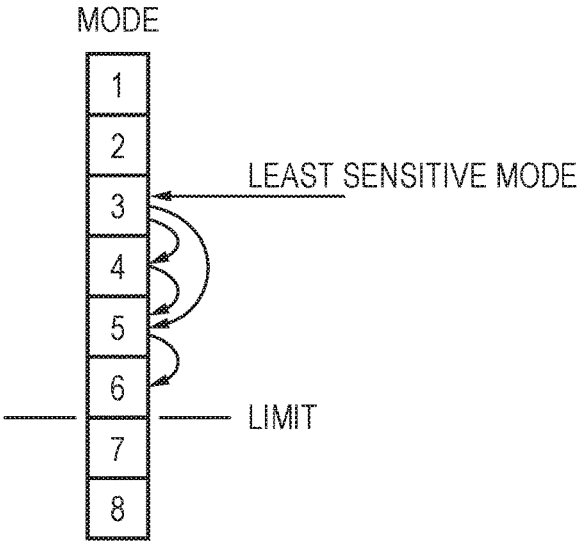
FIG. 4 is a schematic diagram showing a number of different modes of a fire detector unit according to the present invention.

The fire detector system 1 also operates with 8 different modes of sensitivity. These are shown in FIG. 4 in which Mode 1 is the least sensitive mode, and Mode 8 is the most sensitive. When the fire detector system 1 is installed, an installation technician will assess which mode is the least sensitive mode that is acceptable for each fire detector unit 2 taking account of the type of sensor used, the type of fire that it is detecting, the size of the space over which it is detecting a fire, the use of the space in which the fire detector unit is detecting for a fire, the likelihood of a build-up of dirt on the detector unit, and the like. For example, if the fire detector unit 2 is located in a region where welding of metal is taking place, the fire detector unit 2 is likely to be placed in a relatively low sensitivity mode, perhaps Mode 2 or 3, whereas if it is located within an office environment, the least sensitive mode might be one of higher sensitivity, perhaps Mode 5 or 6. Generally speaking, a mode is selected which is the least sensitive that is appropriate for that environment such that any fire will be detected, but the risk of false alarms is minimised. Plainly, in a factory where metal is being welded, setting the mode so that it is too sensitive will cause the regular evacuation of the factory, which is undesirable.

It will be appreciated, therefore, that the alarm installation technician will place the detector in its least sensitive mode when the detector unit 2 is installed. In the example shown in FIG. 4, the least sensitive mode is Mode 3. Modes 3 to 5 can be seen in FIG. 5. In Mode 3, the processor and memory are configured so as to operate as described above in a low sensitivity mode where the alarm point threshold is at 160, and where there is an allowance of 90 for drift up to 250 over time. As described above, this means that, as time elapses, the point at which an alarm will be triggered will increase from 160 to 250. However, once it reaches 250, it reaches the drift compensation limit 12 for Mode 3. The processor 7 and memory 8 are configured so that, once this drift compensation limit has been reached, or as it is approached, the mode is increased from Mode 3 to Mode 4. The effect of changing the mode from 3 to 4 is to increase the sensitivity of the fire detector unit 2 by lowering the alarm point threshold to 225. It is also arranged to increase it to 250 over a period of time as the sensitivity of the detector unit 2 is increased by the accumulation of dirt. By increasing the sensitivity mode from Mode 3 to Mode 4, the time period before which the fire detector unit must be cleaned or replaced is significantly increased, thereby reducing the maintenance cost of the fire detector system 1. In switching from Mode 3 to Mode 4, since the sensitivity of the fire detector unit 2 is increased, there is no reduction in the safety of the system, but the chances of a false alarm occurring are slightly increased.

Once the dynamic range of Mode 4 is approached, the processor 7 and memory 8 change the mode from Mode 4 to Mode 5 to again increase the sensitivity. In Mode 5, the alarm point threshold occurs at 225, and again it compensates for drift over time by increasing the alarm point threshold to 250. Again, the safety of the system is not reduced because the sensitivity of Mode 5 is greater than that of Mode 4.

It will be appreciated that, within each of the modes, the increase in the alarm point threshold 11, 13, 14 corresponds to a first order of drift compensation, and that switching from one mode to another, changing the alarm point threshold to increase sensitivity, and to maintain the alarm point threshold within the dynamic range of the sensor represents a second order of drift compensation. It will be appreciated that, in mode 3, the alarm point threshold 11 is maintained at about 120 above the output signal 10 of the detector as shown by double headed arrow L in FIG. 5. In mode 4, the alarm point threshold 13 is reduced to 100 as indicated by double headed arrow M, and in Mode 5, the down point threshold 14 this is reduced to 60, as indicated by double-headed arrow N.

It will also be appreciated that, by using the second order of drift compensation, the life of the detector unit has been significantly extended by about two times.

At some point, the likelihood of false alarms occurring increases to a point where it is more appropriate to clean or replace the detector unit than to keep on increasing the sensitivity of the detector unit. In this case, that limit, the sensitivity mode limit, occurs once you reach the compensation limit of Mode 6. During the installation of the fire detector unit 2, the installation technician sets the sensitivity mode limit so that, even if there are further, more sensitive, modes, in this case Modes 7 and 8, they will not be available to the system because the chances of false alarms are too great. Thus, once the drift compensation limit for Mode 6 is approached or reached, the fire detector is arranged to signal a latched fault, although it is preferred that a warning is given in advance of the compensation limit being reached.

It will be appreciated that, in different positions and environments, the installation technician will be able to specify different least sensitive modes and different limits for different detector units on a system. For example, the fire detector system 1 might include many fire detector units in different positions around a site, some of which are located in areas such as a factory in which a large amount of dirt is present, and others of which are located in more benign environments such as office space. Thus different detectors on the same system can have different least sensitive modes and limits set by the installation technician. These would be stored in the memory 8.

Additionally, each fire detector unit might include more than one sensor 5, which might be pointing in different directions, or which might be sensing different parameters or which might have different sensitivities. The different sensors can be arranged so as to have different, drift compensation limits, sensitivity mode limits and rates of drift compensation which are different from each other and which are arranged to accommodate drifts of different rates. Where there is more than one sensor, in the least sensitive mode, the sensors will be arranged to have their drift compensation limits, sensitivity mode limits and rates of drift compensation set. Additionally, if one of the sensors reaches its mode limit, it might be appropriate, in the next mode, to operate with only a single sensor. For example, if there is a photo sensor and a heat sensor, and the photo sensor reaches its limit, it may be appropriate for the next mode only to use the heat sensor.

In effect, the present invention has two orders of drift compensation. The first order drift compensation is simply to gradually increase the alarm point threshold of a detector over time to take account of a reduction in response caused, for example, by the build up of dirt. The second order of drift compensation is achieved by having a number of sensitivity modes and switching from one sensitivity mode to a higher sensitivity mode as the drift compensation limit is either reached or approached. It is possible for the sensitivity mode to be increased more than once which gives a potential advantage of the present invention of increasing the capacity for a detector unit to accommodate first order drift several times over.

The sensitivity modes might overlap with each other. In such a case, or, in fact, where they do not overlap, it may be appropriate for the mode to increase not just to the next sensitivity mode but to skip one or more sensitivity modes. In FIG. 4, an arrow is shown in which sensitivity Mode 3 changes directly to Mode 5 as the drift compensation limit for Mode 3 is approached or reached. Potentially, the mode could jump by more than two modes, for example from Mode 3 to Mode 6.

In this way, it is possible to extend the operating period of a fire detector before it must be replaced or cleaned without any detrimental effect on the ability of the detector to detect a fire.

In the embodiment described above, the sensor is an analogue sensor which produces an analogue output signal which is converted to a digital output signal by the analogue to digital convertor 6. As indicated above, the sensor 5 can be replaced with a digital sensor, thereby removing the need for an analogue to digital convertor. Alternatively, the system can be arranged to operate in analogue form, where the processor is capable of interpreting an analogue output signal from the sensor rather than requiring a digital one.

The invention claimed is:

1. A fire detector system comprising:

a fire detector unit;

a sensor disposed in the fire detector unit and arranged to detect characteristics of a fire and to generate an output signal indicative of the characteristics detected by the sensor; and a processor arranged to receive the output signal from the sensor and to generate a fire alarm signal when the output signal exceeds an alarm point threshold;

wherein the system is arranged to change the alarm point threshold over time to compensate for drift in the response of the detector unit to the characteristics of a fire;

wherein the fire detector unit includes a first sensitivity mode with a first drift compensation limit and a second sensitivity mode with a second drift compensation limit, the second sensitivity mode being more sensitive than the first sensitivity mode; and wherein, as the alarm point threshold in the first sensitivity mode approaches or reaches the first drift compensation limit, the system is changed from the first sensitivity mode to the second sensitivity mode.

2. The system according to claim 1, wherein the processor is disposed in the fire detector unit.

3. The system according to claim 1, further comprising a control panel, and wherein the processor is disposed in the control panel.

4. The system according to claim 1, wherein the fire detector unit includes an analogue-to-digital converter which is connected to the sensor and is arranged to generate the output signal.

5. The system according to claim 1, wherein the alarm point threshold of the second sensitivity mode corresponds to a lower output signal of the sensor than the alarm point threshold of the first sensitivity mode.

6. The system according to claim 1, wherein there are at least three sensitivity modes, and wherein, when the sensitivity mode is changed, the sensitivity mode is changed to the sensitivity mode which is immediately more sensitive.

7. The system according to claim 1, wherein there are at least three sensitivity modes, and wherein, when the sensitivity mode is changed, the sensitivity mode can be changed to a sensitivity mode which is more sensitive than the sensitivity mode that is immediately more sensitive.

8. The system according to claim 1, wherein the processor is arranged to have a most sensitive sensitivity mode limit which defines the most sensitive mode into which the fire detector unit can be placed.

9. The system according to claim 1, wherein the processor is arranged to have a least sensitive sensitivity mode limit which defines the least sensitive mode into which the fire detector unit can be placed.

10. The system according to claim 1, further comprising a memory.

11. The system according to claim 1, further comprising a second sensor.

12. The system according to claim 11, wherein the sensors are both arranged such that the sensors can be set to compensate for drift independently of each other.

13. The system according to claim 11, wherein the sensors can be arranged to have different settings of one or more of the following: rate of drift compensation; drift compensation limit; most sensitive sensitivity mode limit; and least sensitive sensitivity mode limit.

14. The system according to claim 11, wherein the sensors are disposed in the fire detector unit.

15. The system according to claim 11, further comprising a second fire detector unit in which the second sensor is disposed.

16. A method of compensating for drift in a fire detector unit having a sensor arranged to detect characteristics of a fire and to generate an output signal indicative of the characteristics detected by the sensor, the method involving a processor arranged to receive the output signal from the sensor and to control the response by indicating a fire when the output signal exceeds an alarm point threshold, the method comprising:

(1) placing the fire detector unit in a first sensitivity mode with a first drift compensation limit;

(2) changing the alarm point threshold over time to compensate for drift in the response of the detector unit to the characteristics of a fire;

(3) changing the mode of the unit from the first sensitivity mode to a second sensitivity mode with a second drift compensation limit and which is a more sensitive mode than the first sensitivity mode as the alarm point threshold in the first sensitivity mode approaches or reaches the first drift compensation limit;

(4) changing the alarm point threshold over time to compensate for drift in the response of the detector unit to the characteristics of a fire.

17. The method of claim 16, wherein the output signal is a digital output signal.

18. The method of claim 17, wherein the sensor generates an analogue output signal which is converted to a digital output signal.

19. The method according to claim 16, wherein the alarm point threshold of the second sensitivity mode corresponds to a lower output signal from the sensor than that of the alarm point threshold of the first sensitivity mode.

20. The method according to claim 16, further comprising:

changing the mode of the unit from the second sensitivity mode to a third sensitivity mode with a third drift compensation limit and which is a more sensitive mode than the second sensitivity mode as the alarm point threshold in the second sensitivity mode approaches or reaches the second drift compensation limit.

21. The method according to claim 16, wherein the fire detector unit has at least three sensitivity modes, and when the sensitivity mode is changed, the sensitivity mode is changed to the sensitivity mode which is immediately more sensitive.

22. The method according to claim 16, wherein the fire detector unit has at least three sensitivity modes, and wherein, when the sensitivity mode is changed, the sensitivity mode can be changed to a sensitivity mode which is more sensitive than the sensitivity mode that is immediately more sensitive.

23. The method according to claim 16, wherein the fire detector unit is arranged to have a most sensitive sensitivity mode limit which defines the most sensitive mode into which the fire detector unit can be placed.

24. The method according to claim 16, wherein the fire detector unit is arranged to have a least sensitive sensitivity mode limit which defines the least sensitive mode into which the fire detector unit can be placed.

25. The method according to claim 16, including a second sensor, and wherein the sensors are arranged such that the sensors can be set to compensate for drift independently of each other.

26. The method according to claim 25, wherein the sensors can be arranged to have different settings of one or more of the following: rate of drift compensation; drift compensation limit; most sensitive sensitivity mode limit; and least sensitive sensitivity mode limit.

27. The method according to claim 25 further comprising a second fire detector unit in which the second sensor is disposed.

28. A fire detector unit comprising;

a sensor disposed in the fire detector unit and arranged to detect characteristics of a fire and to generate an output signal indicative of the characteristics detected by the sensor; and a processor arranged to receive the output signal from the sensor and to control the response by indicating a fire when the output signal exceeds an alarm point threshold;

wherein the fire detector unit is arranged to change the alarm point threshold over time to compensate for drift in the response of the detector unit;

wherein the fire detector unit includes a first sensitivity mode with a first drift compensation limit and a second sensitivity mode with a second drift compensation limit, the second sensitivity mode being more sensitive than the first; and wherein, as the first alarm point threshold in the first sensitivity mode is approached or reached, the fire detector unit is changed from the first sensitivity mode to the second sensitivity mode.

29. The system according to claim 1, wherein the first and second drift compensation limits represent points at which the alarm point threshold reaches or approaches an end of a dynamic range of the sensor.

* * * * *